US007440705B2

(12) United States Patent
Hatakeyama

(10) Patent No.: US 7,440,705 B2
(45) Date of Patent: Oct. 21, 2008

(54) IMAGE FORMING APPARATUS WITH TONER CARTRIDGE AND THE TONER CARTRIDGE

(75) Inventor: Motonobu Hatakeyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 166 days.

(21) Appl. No.: 11/375,237

(22) Filed: Mar. 15, 2006

(65) Prior Publication Data

US 2006/0216046 A1 Sep. 28, 2006

(30) Foreign Application Priority Data

Mar. 24, 2005 (JP) ..... 2005-085234

(51) Int. Cl.
*G03G 15/00* (2006.01)
*G03G 15/08* (2006.01)
*G03G 21/18* (2006.01)

(52) U.S. Cl. ..... 399/27; 399/12; 399/25

(58) Field of Classification Search ..... 399/27, 399/12, 24, 25, 262, 258, 260; 222/DIG. 1; 347/19

See application file for complete search history.

(56) References Cited

U.S. PATENT DOCUMENTS

2003/0021609 A1* 1/2003 Yamaguchi et al. ..... 399/27
2004/0095459 A1* 5/2004 Russell et al. ..... 347/240
2004/0135838 A1* 7/2004 Owen et al. ..... 347/19
2005/0117919 A1* 6/2005 Ito et al. ..... 399/27
2005/0265738 A1* 12/2005 Ogata ..... 399/27
2006/0127108 A1* 6/2006 Okuyama et al. ..... 399/27

FOREIGN PATENT DOCUMENTS

JP 09-146358 A * 6/1997
JP 2001-134062 A * 5/2001
JP 2003-50505 2/2003

* cited by examiner

*Primary Examiner*—Sophia S Chen
(74) *Attorney, Agent, or Firm*—Kubotera & Associates, LLC

(57) ABSTRACT

An image forming apparatus includes an image forming unit for forming an image, and a toner cartridge detachably attached to the image forming unit for supplying toner to the image forming unit. The image forming apparatus further includes a toner supply control unit for controlling an amount of toner supplied from the toner cartridge to the image forming unit; a remaining toner amount detection unit for detecting a remaining amount of toner in the image forming unit; an image forming unit used amount detection unit for detecting a used amount of the image forming unit; and a control unit for controlling the toner supply control unit to control the amount of toner in the image forming unit according to a detection result of the remaining toner amount detection unit and a calculation result of the image forming unit used amount detection unit.

19 Claims, 15 Drawing Sheets

FIG. 11 (a)
FIG. 11 (c)
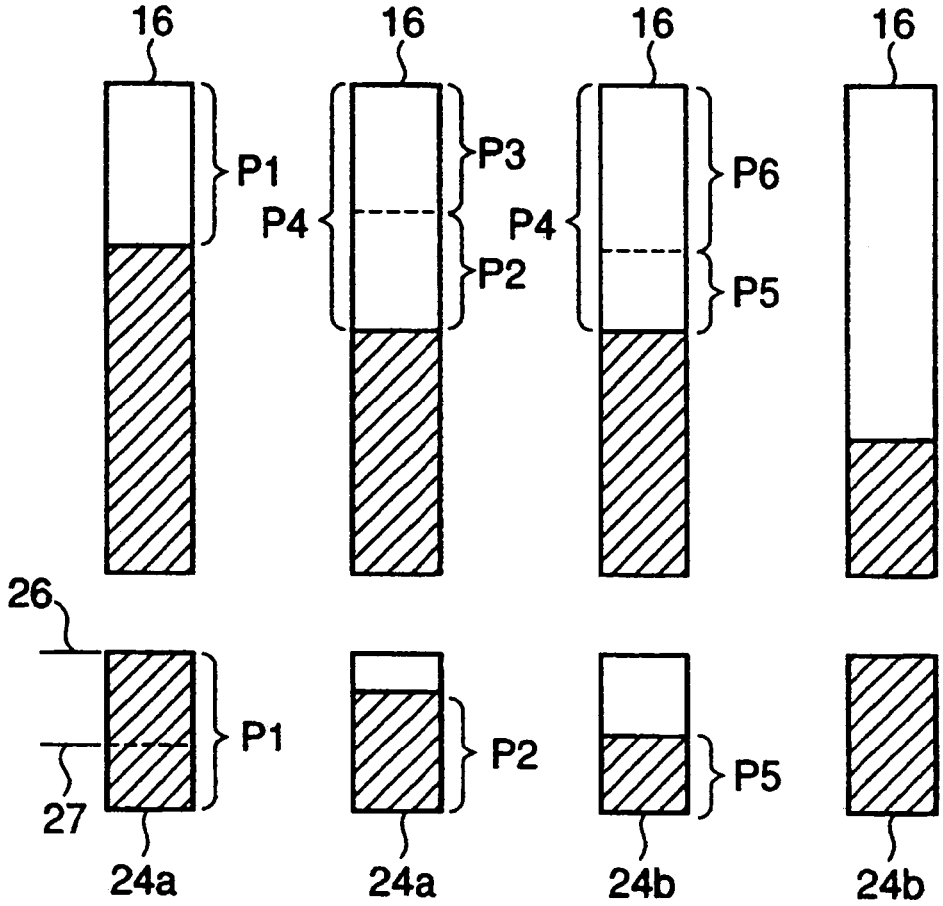
FIG. 11 (b)
FIG. 11 (d)
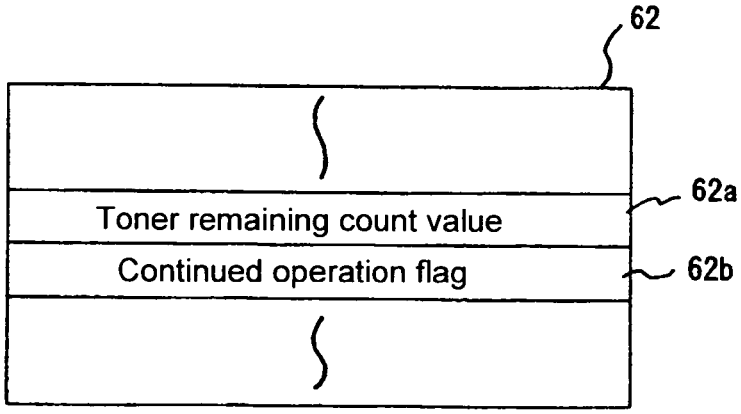
FIG. 12

IMAGE FORMING APPARATUS WITH TONER CARTRIDGE AND THE TONER CARTRIDGE

BACKGROUND OF THE INVENTION AND RELATED ART STATEMENT

The present invention relates to an image forming apparatus such as an electric-photo printing apparatus, a copier, a facsimile, and a multifunctional printing apparatus. In particular, the present invention relates to an image forming apparatus with a toner cartridge detachable thereto for retaining developer, and the toner cartridge provided in the image forming apparatus.

In a conventional image forming apparatus such as an electric-photo printer, toner is retained in a cartridge as developer, and the cartridge is detachably attached to the image forming apparatus, so that toner can be replenished repeatedly. In the image forming apparatus having such a cartridge, it is necessary to detect a remaining amount of toner in the toner cartridge, and to replace the toner cartridge when the remaining amount of toner becomes too small.

In an image forming apparatus disclosed in Patent reference, a rotatable stirring shaft is disposed in a toner cartridge. A rotational timing of the stirring shaft is measured to detect a remaining amount of toner in the toner cartridge.

In such an image forming apparatus, an image forming unit is provided for forming an image. The image forming unit includes a photosensitive drum; a charge unit disposed around the photosensitive drum; a developing unit; and a cleaning unit. In the image forming unit, a toner image is formed on the photosensitive drum. The photosensitive drum has a certain life, and needs to be replaced at the end of the life. Accordingly, the image forming unit is adapted to be detachable relative to a main body of the image forming apparatus, and the toner cartridge is attached to the image forming unit.

Patent Reference: Japanese Patent Publication No. 2003-50505

In the conventional image forming apparatus described above, when the image forming unit is replaced at the end of the life thereof, the toner cartridge is removed from the image forming unit. In this case, if a certain amount of toner is already supplied to the image forming unit from the toner cartridge, the toner in the image forming unit is also discarded, thereby wasting toner.

In view of the problems described above, an object of the present invention is to provide an image forming apparatus, in which it is possible to prevent toner from wasting. Another object of the present invention is to provide a toner cartridge, in which it is possible to prevent toner from wasting.

Further objects and advantages of the invention will be apparent from the following description of the invention.

SUMMARY OF THE INVENTION

In order to attain the objects described above, according to a first aspect of the present invention, an image forming apparatus includes an image forming unit for forming an image, and a toner cartridge detachably attached to the image forming unit for supplying toner to the image forming unit. The image forming apparatus further includes a toner supply control unit for controlling an amount of toner supplied from the toner cartridge to the image forming unit; a remaining toner amount detection unit for detecting a remaining amount of toner in the image forming unit; an image forming unit used amount detection unit for detecting a used amount of the image forming unit; and a control unit for controlling the toner supply control unit to control the amount of toner in the image forming unit according to a detection result of the remaining toner amount detection unit and a calculation result of the image forming unit used amount detection unit.

According to a second aspect of the present invention, an image forming apparatus includes an image forming unit for forming an image, and a toner cartridge detachably attached to the image forming unit for supplying toner to the image forming unit. The toner cartridge has a storage medium for storing information from the image forming apparatus. The toner cartridge includes a used toner amount calculation unit for calculating a used amount of toner; a remaining toner amount detection unit for detecting a remaining amount of toner in the image forming unit; a remaining toner amount storage unit for storing a detection result of the remaining toner amount detection unit; a toner information writing unit for writing used toner amount information calculated by the used toner amount calculation unit and remaining toner amount information detected by the remaining toner amount detection unit to a storage medium disposed in the toner cartridge; a toner information reading unit for reading the used toner amount information and the remaining toner amount information stored in the storage medium disposed in the toner cartridge; and a replacement detection unit for detecting that the toner cartridge is replaced.

According to the second aspect of the present invention, the replacement detection unit detects that the toner cartridge is replaced. Then, a reusable amount of toner is calculated based on the used toner amount information and the remaining toner amount information read by the toner information reading unit and the remaining toner amount stored in the remaining toner amount storage unit.

In the first aspect of the invention, the control unit is provided for controlling the toner supply control unit to control the amount of toner in the image forming unit according to the detection result of the remaining toner amount detection unit and the calculation result of the image forming unit used amount detection unit. Accordingly, it is possible to use toner in the image forming unit without wasting.

In the second aspect of the invention, after the replacement detection unit detects that the toner cartridge is replaced, the reusable amount of toner is calculated based on the used toner amount information and the remaining toner amount information read by the toner information reading unit and the remaining toner amount stored in the remaining toner amount storage unit. Accordingly, it is possible to precisely display the remaining toner amount when the toner cartridge is replaced.

BRIEF DESCRIPTION OF THE DRAWINGS

FIGS. 11(*a*) to 11(*d*) are schematic views showing a change in an amount of toner in a toner cartridge;

FIG. 12 is a schematic view showing a memory map of a non-volatile memory according to a third embodiment of the present invention;

DETAILED DESCRIPTION OF PREFERRED EMBODIMENTS

Figure 1:
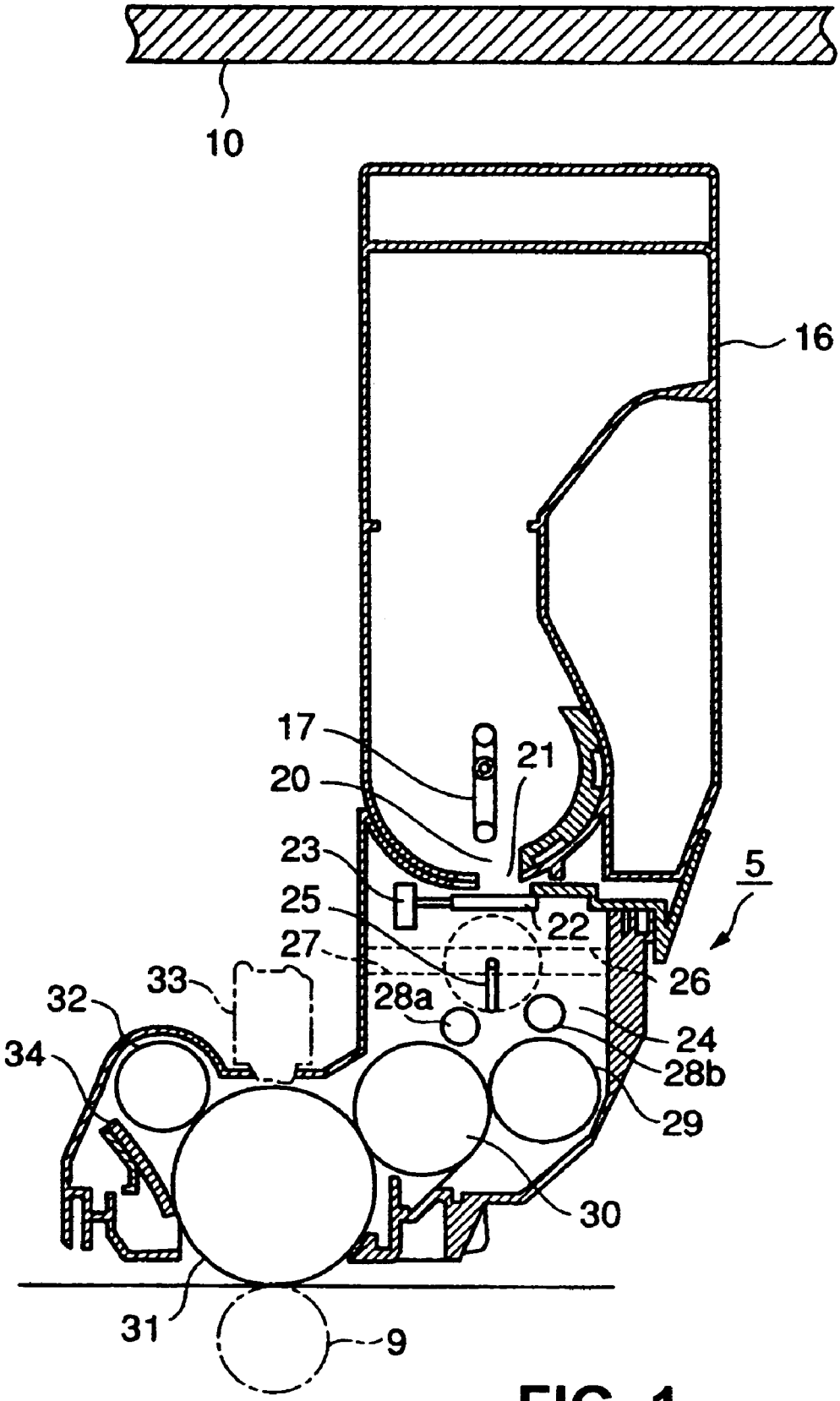
FIG. 1 is a schematic sectional view showing an electric-photo printing apparatus according to a first embodiment of the present invention.
Figure 2:
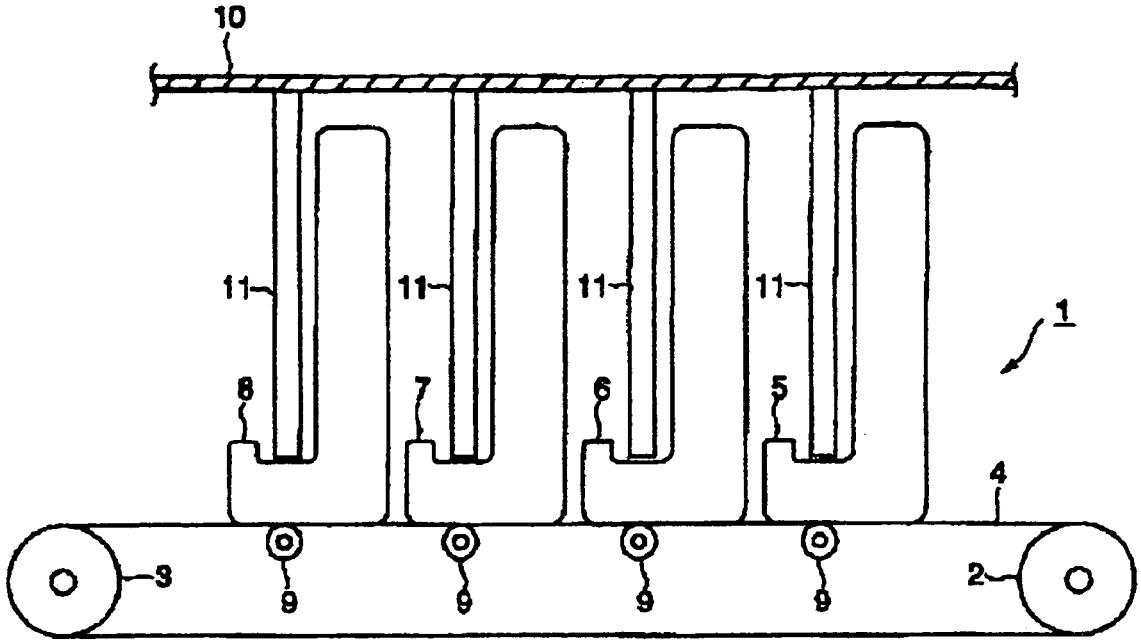
FIG. 2 is a schematic view showing the electric-photo printing apparatus.

Hereunder, embodiments of the present invention will be explained with reference to the accompanying drawings. FIG. 1 is a schematic sectional view showing an electric-photo printing apparatus according to a first embodiment of the present invention. FIG. 2 is a schematic view showing the electric-photo printing apparatus. In the embodiments, the electric-photo printing apparatus is used as an image forming apparatus. A configuration of the electric-photo printing apparatus will be explained with reference to FIG. 2.

As shown in FIG. 2, in an electric-photo printing apparatus 1, a medium transport belt 4 is provided between drive rollers 2 and 3 along a transport direction of a medium. Image forming units 5 to 8 having an identical configuration are disposed along the medium transport belt 4 for forming toner images in yellow, magenta, cyan, and black, respectively. Transfer rollers 9 are also disposed along the medium transport belt 4. Protruding portions 11 are disposed on a cover 10 of the electric-photo printing apparatus 1, and are provided with LED heads at distal ends thereof as exposure units.

FIG. 1 is a schematic sectional view showing the electric-photo printing apparatus with a toner cartridge mounted thereon. As shown in FIG. 1, a toner cartridge 16 is detachably attached to the image forming unit 5. (in FIG. 1, the image forming unit 5 in yellow is shown. A configuration is the same as those of other image forming units.) Toner is retained in the toner cartridge 16 as developer, and a stirring bar 17 is disposed in the toner cartridge 16 to be rotatable therein.

A supply opening 20 is formed in the toner cartridge 16 at a lower portion thereof for supplying toner to the image forming unit 5. An inlet opening 21 corresponding to the supply opening 20 is formed in the image forming unit 5. A shutter 22 is disposed below the inlet opening 21 to be movable as a regulating member. When a shutter driving unit 23 (solenoid and the like) moves the shutter 22 to a left side in FIG. 2 in a horizontal direction, the inlet opening 21 is opened. When the shutter 22 moves to a right side in FIG. 2, the inlet opening 21 is closed. Accordingly, it is possible to adjust an amount of toner supplied to the image forming unit 5 through controlling the shutter driving unit 23.

A toner storage portion 24 is formed below the shutter 22. A toner sensor lever 25 is disposed in the toner storage portion 24 for detecting a remaining amount of toner. The toner sensor lever 25 is formed in a crank shape to be rotatable. The toner storage portion 24 has a shape extending in a longitudinal direction of the image forming unit in a rotational range of the toner sensor lever 25, and the toner sensor lever 25 extends inside the extending portion of the toner storage portion 24. A toner sensor 25*a* is disposed below the extending portion of the toner storage portion 24.

The toner sensor 25*a* for detecting a remaining amount of toner will be explained with reference to FIGS. 17(*a*) and 17(*b*). In the toner sensor 25*a*, a magnet 151*a* is disposed at a distal end of a lever 151. The lever 151 is arranged such that a rear end of the lever 151 crosses a photo-interrupter 152. A spring (not shown) urges the lever 151 in an arrow direction C.

Figure 17:
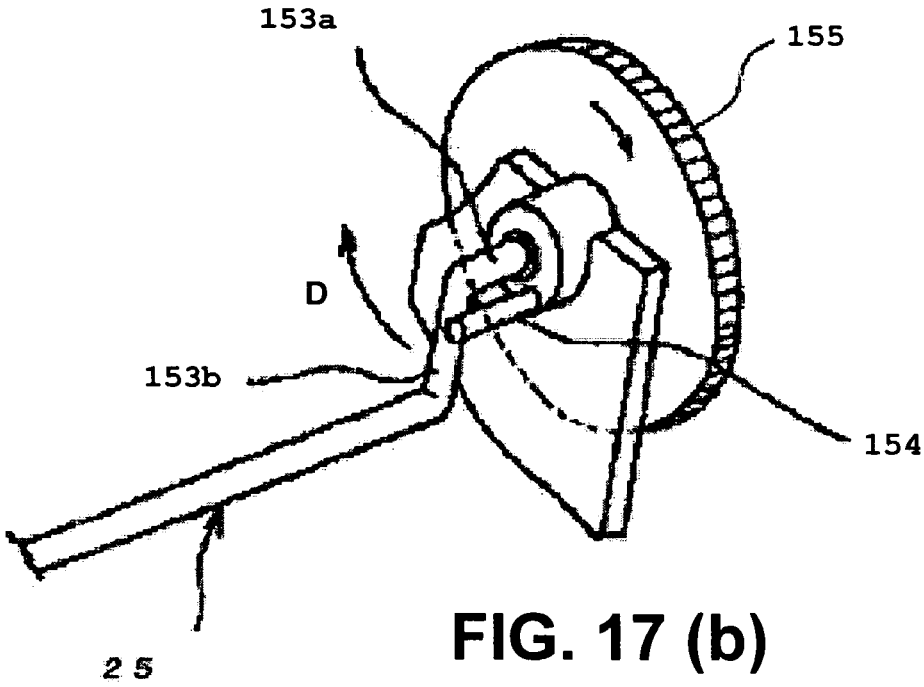
FIGS. 17(*a*) and 17(*b*) are views showing a toner sensor of the electro-photo printing apparatus.
Figure 17:
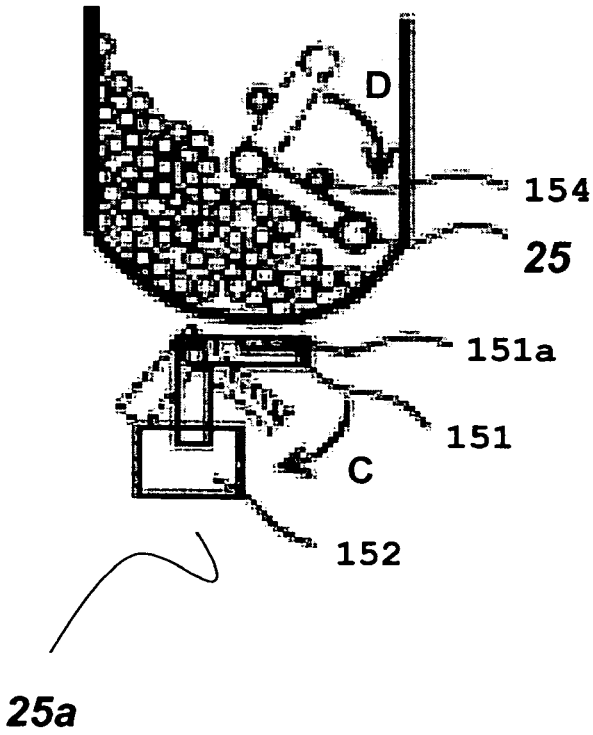

As shown in FIG. 17(*b*), a rotational shaft 153*a* of the toner sensor lever 25 is inserted into a center portion of a gear 155 and supported independently from the gear 155. The rotational shaft 153*a* engages the gear 155 to be rotatable in one direction. When the gear 155 rotates in an arrow direction D, a protrusion 154 pushes an arm portion 153*b* of the toner sensor lever 25 to rotate the toner sensor lever 25 in the arrow direction D. A portion of the arm portion 153*b* is formed of a magnetic material to be attracted toward the magnet 151*a*.

With the structure described above, when the arm portion 153*b* is situated at a low position, the magnet 151*a* disposed on the lever 151 attracts the lever 151 in a direction opposite to the arrow direction C, so that the lever 151 moves to a position indicated by a solid line in FIG. 17(*a*) in a direction opposite to the arrow direction C, thereby blocking the photo-interrupter 152. When the arm portion 153*b* is situated at a position other than the low position, the magnet 151*a* disposed on the lever 151 does not attract the lever 151, so that the lever 151 moves to a position indicated by a hidden line in FIG. 17(*a*) in the arrow direction C, thereby not blocking the photo-interrupter 152.

Figure 18:
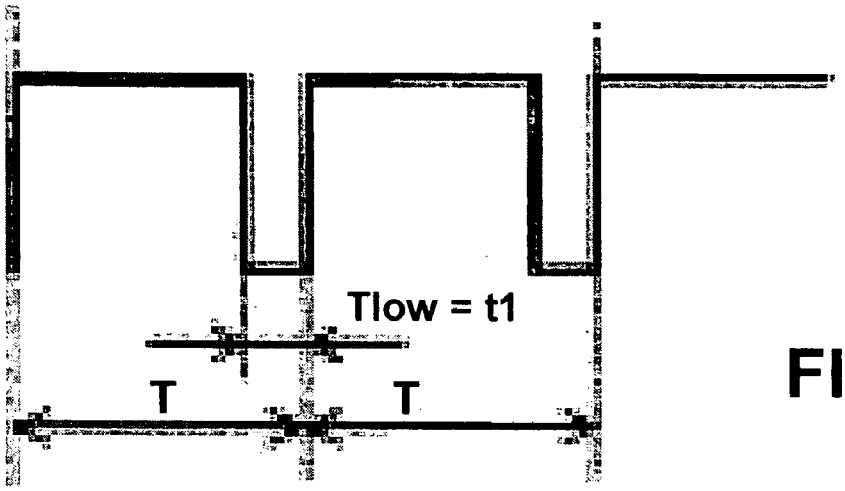
FIG. 18(*a*) and 18(*b*) are charts showing output signals of a photo-interrupter of the toner sensor.
Figure 18:
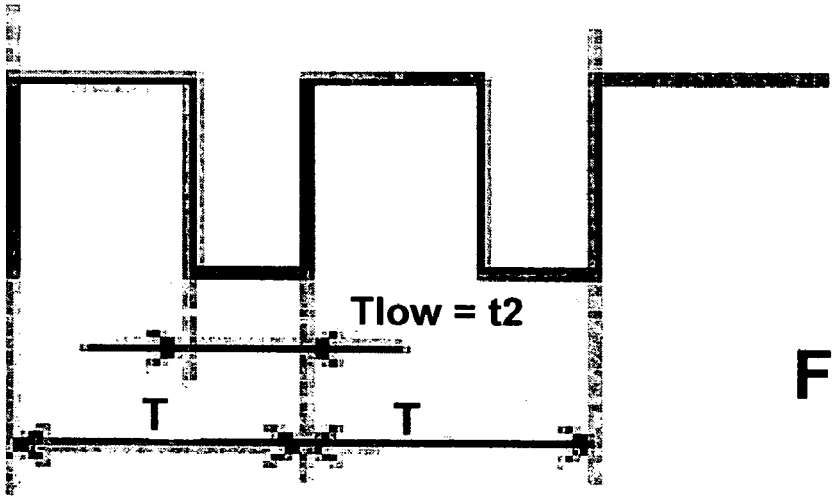

A remaining amount of toner is detected through the following process. When a plenty amount of toner is retained in the toner storage portion 24, the arm portion 153*b* always receives resistance from toner. Accordingly, the arm portion 153*b* is not separated from the protrusion 154 and rotates at a constant speed. In this case, the photo-interrupter 152 outputs a signal as shown in FIG. 18(*a*), wherein T is a rotational cycle of the gear 155 and an attraction time tlow of the magnet 151*a* becomes t1. When an amount of toner becomes about a half, the resistance received on the arm portion 153*b* decreases as the arm portion 153*b* passes through an upper position. Accordingly, the arm portion 153*b* is separated from the protrusion 154 through its own weight and falls downwardly. As a result, the arm portion 153*b* stays at a lower position for a longer period of time, so that the attraction time tlow of the magnet 151*a* becomes t2 larger than t1 as shown in FIG. 18(*b*). A relationship between a remaining amount of toner and the attraction time tlow of the arm portion 151*a* is determined in advance. Accordingly, it is possible to detect a remaining amount of toner by measuring the attraction time tlow of the magnet 151*a*.

In the embodiment, at least two threshold levels, i.e., a toner full level 26 and a toner low level 27 as indicated by hidden lines in FIG. 1, are provided for detecting two different toner levels. Just one threshold level may be provided, so that a level of toner is judge according to a position below or above the threshold level.

Stirring screws 28*a* and 28*b* are provided at a lower portion of the toner storage portion 24 for stirring toner in the toner storage portion 24. A supply roller 29 is also provided at the lower portion of the toner storage portion 24 for supplying toner inside the toner storage portion 24 to a developer roller 30. A photosensitive drum 31 is provided at a lower portion of the image forming unit 5 to be rotatable. Around the photosensitive drum 31, there are provided a charge roller 32; an LED head 33 as an exposure unit; the developer roller 30; and a cleaning member 34. With the configuration described above, a toner image is formed on the photosensitive drum 31 through an electric-photo process.

Figure 3:
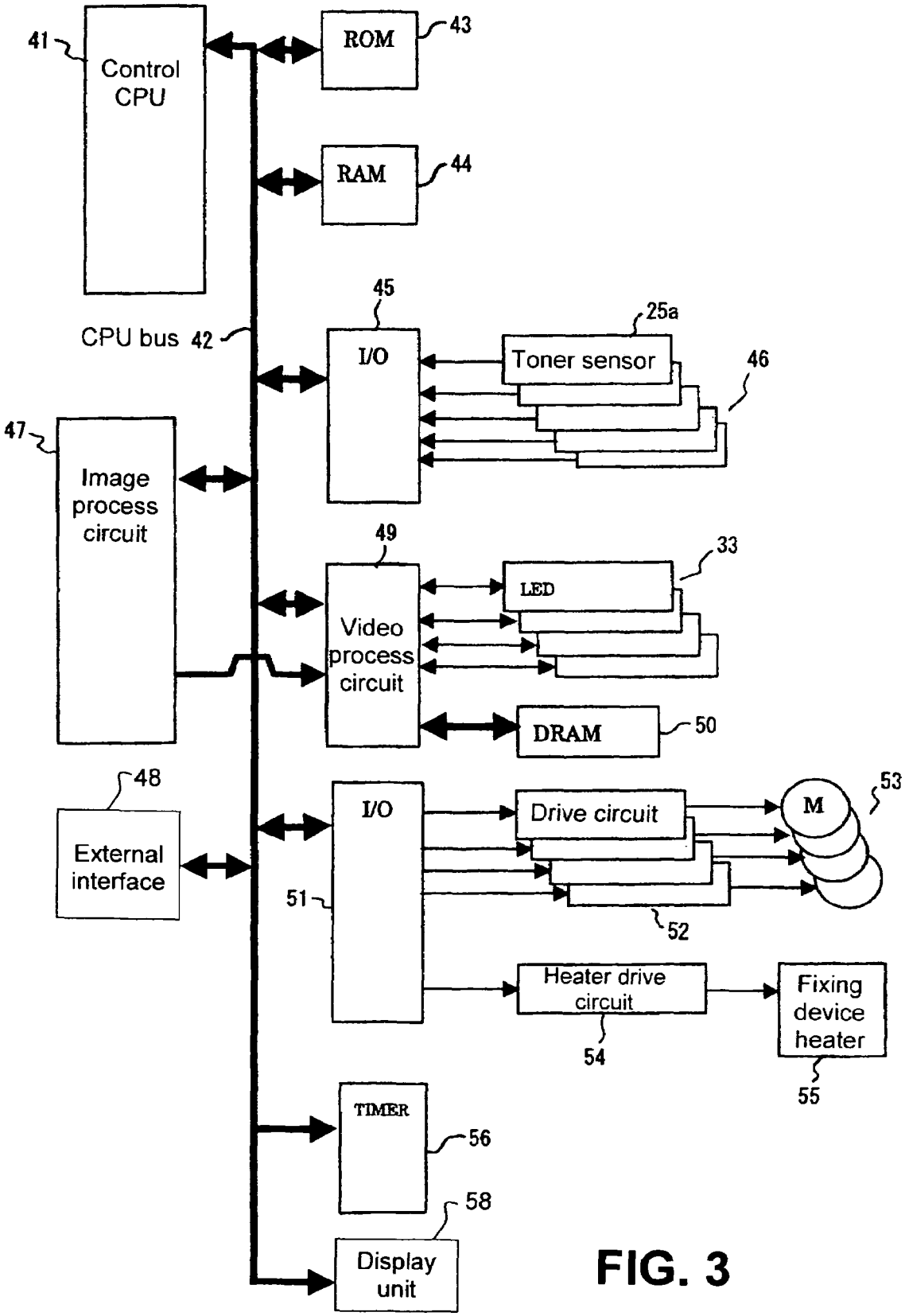
FIG. 3 is a block diagram showing a control system of the electric-photo printing apparatus according to the first embodiment of the present invention.

FIG. 3 is a block diagram showing a control system of the electric-photo printing apparatus 1 according to the first embodiment of the present invention. As shown in FIG. 3, a control CPU 41 is connected to other circuits through a CPU bus 42 for controlling a whole operation of the electric-photo printing apparatus 1. A program ROM 43 is connected to the CPU bus 42 for storing a control program in advance, so that the control CPU 41 executes each process according to a sequence of the control program. A work RAM 44 is connected to the CPU bus 42 for temporarily storing a variable and data necessary for executing the process. Further, a display unit 58 is connected to the CPU bus 42.

An input/output circuit 45 connected to the CPU bus 42 is connected to various sensors 46 including the toner sensor 25*a*. The toner sensor 25*a* detects an operation timing of the toner sensor lever 25 described above. The control CPU 41 detects a remaining amount of toner in the image forming unit 5 through a detection signal of the toner sensor 25*a*.

An image process circuit 47 is connected to the CPU bus 42 for receiving image data sent from an upper device (not shown) through an external interface 48, and for sending the image data to a video process circuit 49 connected to the CPU bus 42. The video process circuit 49 temporarily stores the image data in a DRAM 50. According to a print timing generated in the control CPU 41, the input/output circuit 45 reads the image data from the DRAM 50 and sends the image data to the LED heads 33, so that an electro-optical image is formed on the photosensitive drum 31. A dot-counter is provided in the video process circuit 49 for counting the number of printed dots according to the image data sent to the LED heads 33.

An output circuit 51 connected to the CPU bus 42 is connected to drive circuits 52 including the shutter drive unit 23 for driving the shutter 22 in the image forming unit 5. Actuators 53 such as various motors and clutches are connected to the drive circuits 52 for performing an operation such as print sheet transportation according to an instruction from the control CPU 41. A heater drive circuit 54 is connected to the output circuit 51 for heating a fixing device heater 55 so that toner transferred to a print sheet is fixed.

A plurality of timers is disposed in a timer circuit 56 connected to the CPU bus 42 for measuring a period of time such as the print timing and drive timing of the various actuators. Accordingly, the control CPU 41 executes various processes according to a timing measured by the timer circuit 56.

Figure 4:
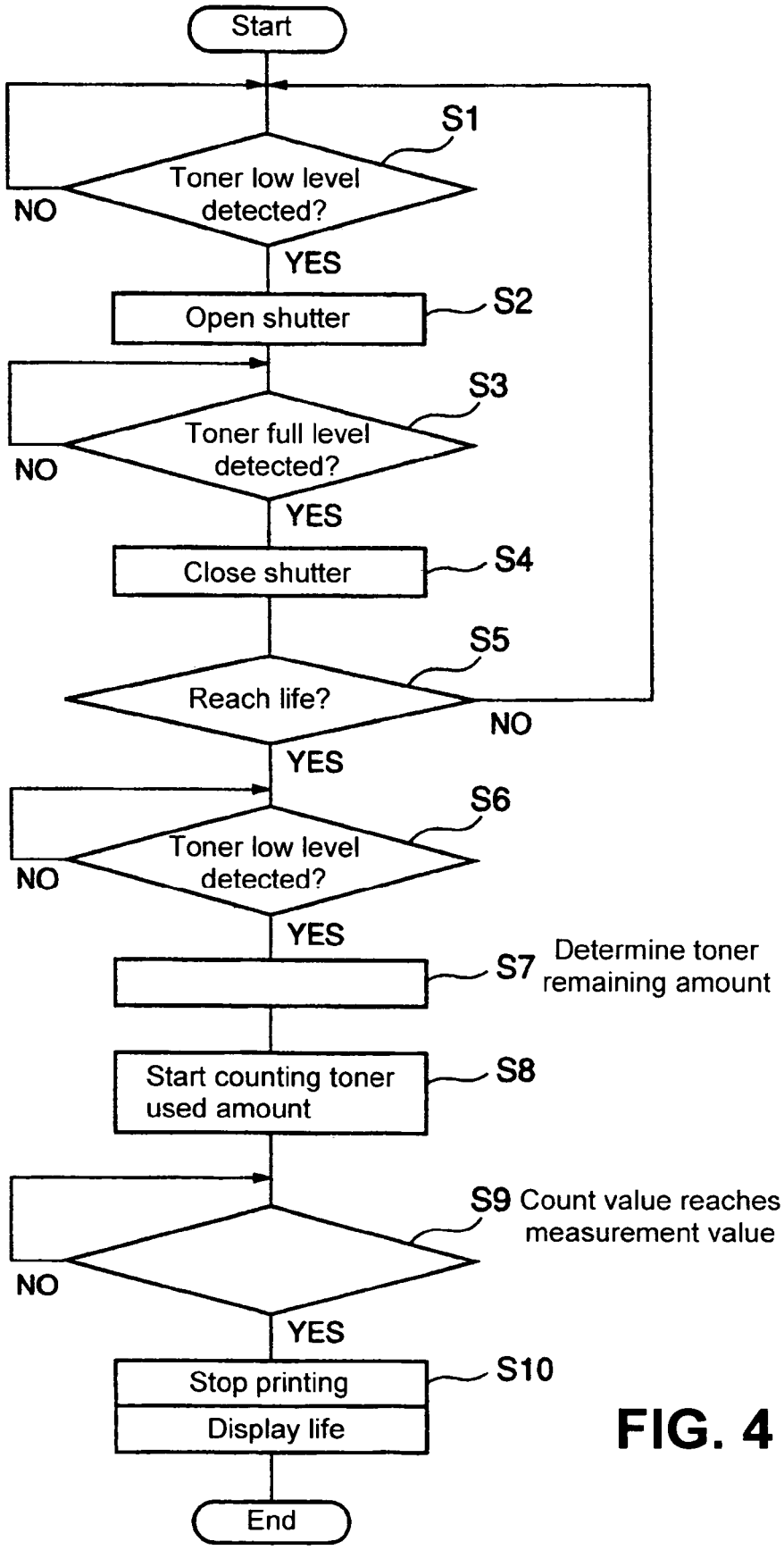
FIG. 4 is a flow chart showing an operation of the electric-photo printing apparatus according to the first embodiment of the present invention.

An operation of the electric-photo printing apparatus will be explained next. FIG. 4 is a flow chart showing the operation of the electric-photo printing apparatus 1 according to the first embodiment of the present invention. In the electric-photo printing apparatus 1 shown in FIG. 1, when the toner cartridge 16 is attached to the image forming unit 5, and the supply opening 20 and the shutter 22 are opened, toner in the toner cartridge 16 is supplied to the image forming unit 5. When the toner sensor lever 25 and the toner sensor 25*a* detect that an amount of toner in the toner storage portion 24 reaches the toner full level 26, the control CPU 41 drives the shutter driving unit 23 to close the shutter 22.

As the electric-photo printing apparatus 1 performs the printing operation, toner in the toner storage portion 24 is consumed gradually. When the toner sensor lever 25 and the toner sensor 25*a* detect that an amount of toner in the toner storage portion 24 decreases and reaches to the toner low level 27 (step S1), the control CPU 41 drives the shutter driving unit 23 to open the shutter 22 (step S2). Accordingly, toner is supplied again, and when an amount of toner reaches the toner full level 26 (step S3), the control CPU 41 drives the shutter driving unit 23 to close the shutter 22 (step S4). This operation is repeated so that an amount of toner in the toner storage portion 24 is maintained between the toner full level 26 and the toner low level 27.

Figure 5:
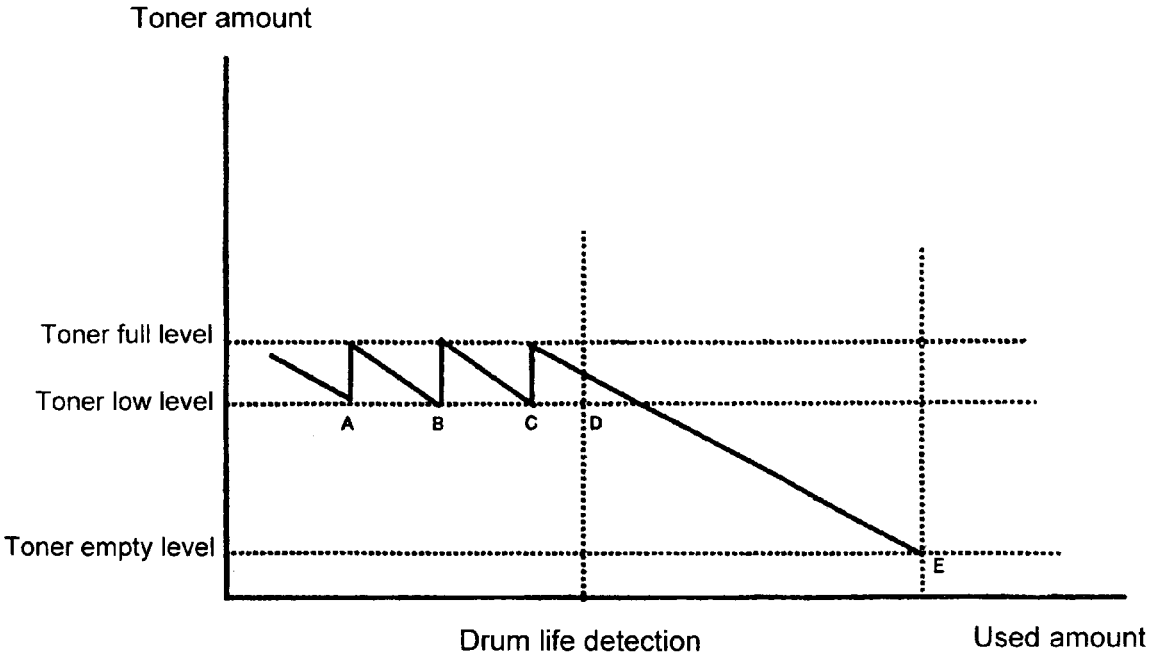
FIG. 5 is a graph showing a change in an amount of toner in a toner storage portion.

FIG. 5 is a graph showing a change in an amount of toner in the toner storage portion 24. As shown in FIG. 5, an amount of toner reaches the toner low level 27 at points A, B, and C, and toner is supplied from the toner cartridge 16, so that am amount of toner returns to the toner full level 26. In the printing operation, the photosensitive drum 31 shown in FIG. 1 rotates, and the number of rotations is counted with a counter (not shown). The number of rotations represents a used amount of the photosensitive drum 31. When the number of rotations reaches a specific level, it is considered that a life of the image forming unit is completed. In FIG. 5, a life of the image forming unit is completed at a point D. Even though it is detected that the life of the image forming unit is completed in step S5, the control CPU 41 continues the printing operation, and toner in the toner storage portion 24 continues decreasing.

When it is detected that a mount of toner reaches the toner low level 27 in step S6, the control CPU 41 continues the printing operation without opening the shutter 22. At the time when it is detected that a mount of toner reaches the toner low level 27, the control CPU 41 set "a remaining amount of toner in the image forming unit upon detection of the toner low level" determined in advance in a counter (inside counter) disposed in the video process circuit 49 (step S7). At the same time, the control CPU 41 controls the inside counter to count a remaining amount of toner in the image forming unit (step S8). More specifically, a remaining amount of toner is determined by counting the number of printed dots. The inside counter decreases according to the number of printed dots.

When the count number of the inside counter reaches a specific level as the printing operation is continued (at point E in FIG. 5; step S9), the control CPU 41 determines that a remaining amount of toner in the image forming unit reaches an empty level. Accordingly, the control CPU 41 stops the printing operation, and notifies a user that the image forming unit reaches the life thereof (step S10). At this point, a remaining amount of toner in the image forming unit becomes almost zero, thereby not wasting toner when the image forming unit is replaced. It may be arranged such that a remaining amount obtained by the inside counter is displayed upon a request of the user before a remaining amount of toner reaches the empty level.

In FIG. 5, it is assumed that all of print duties of printed patterns are the same for the sake of explanation. Accordingly, a used amount of the image forming unit changes linearly relative to a remaining amount of toner. In an actual case, a print duty of a printed pattern is not constant, so that a used amount of the image forming unit does not change linearly relative to a remaining amount of toner.

In the embodiment, upon the detection of the toner low level 27, "a remaining amount of toner in the image forming unit upon detection of the toner low level" is set in the inside counter, and the inside counter decreases from this point. It may be arranged such that upon the detection of the toner full level 26, "a remaining amount of toner in the image forming unit upon detection of the toner full level" is set in the inside counter, and the inside counter decreases from this point.

In the embodiment, when the count number of the inside counter reaches a specific level, it is determined that toner reaches the toner empty level, thereby stopping the printing operation. It may be arranged such that when the count number of the inside counter reaches a specific level, it is determined that toner reaches a toner near-empty level. At this moment, it is displayed that the image forming unit reaches the life thereof, and the printing operation may be continued.

Figure 6:
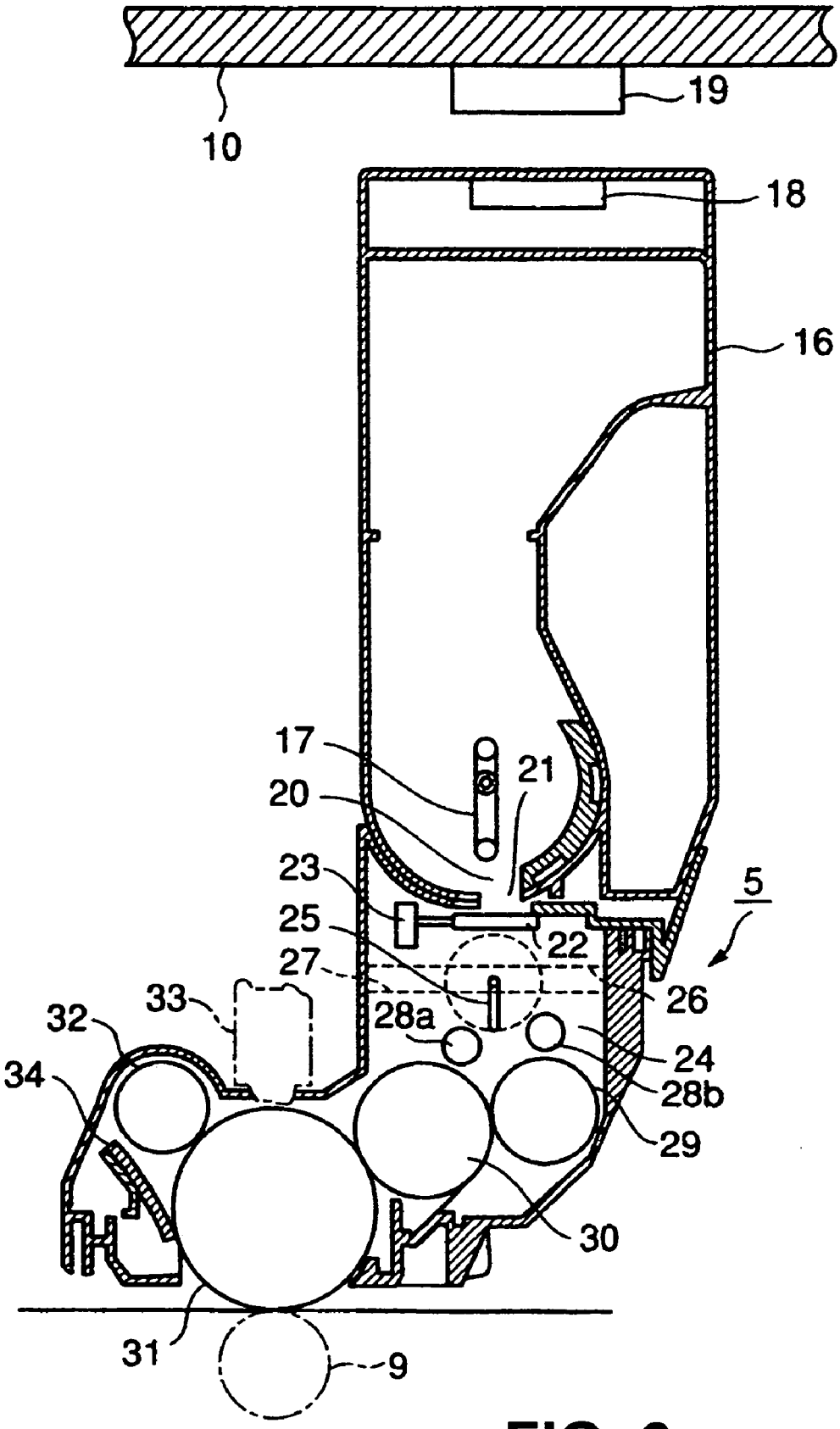
FIG. 6 is a schematic sectional view showing an electric-photo printing apparatus according to a second embodiment of the present invention.

A second embodiment of the present invention will be explained next. FIG. 6 is a schematic sectional view showing an electric-photo printing apparatus according to the second embodiment of the present invention. As shown in FIG. 6, a radio frequency identification (RFID) tag 18 is disposed at an upper portion of the toner cartridge 16. The RFID tag 18 is formed of a substrate board; an IC chip; and an antenna connected to the IC chip. The IC chip is formed of a reader/writer; a transmission unit and a reception unit for communication; a memory unit for storing data; and a power source.

An RFID reader 19 is disposed on a back surface of the cover 10 of the electric-photo printing apparatus. The RFID reader 19 is formed of a controller and an antenna connected to the controller. When the RFID tag 18 approaches the antenna of the RFID reader 19, the antenna of the RFID tag 18 receives radio wave from the antenna of the RFID reader 19, thereby generating an electromotive force. The power source of the RFID tag 18 generates operational power with the electromotive force. The IC chip operates using the operational power to transmit and receive data relative to the RFID reader 19. Other components are the same as those in the first embodiment.

Figure 7:
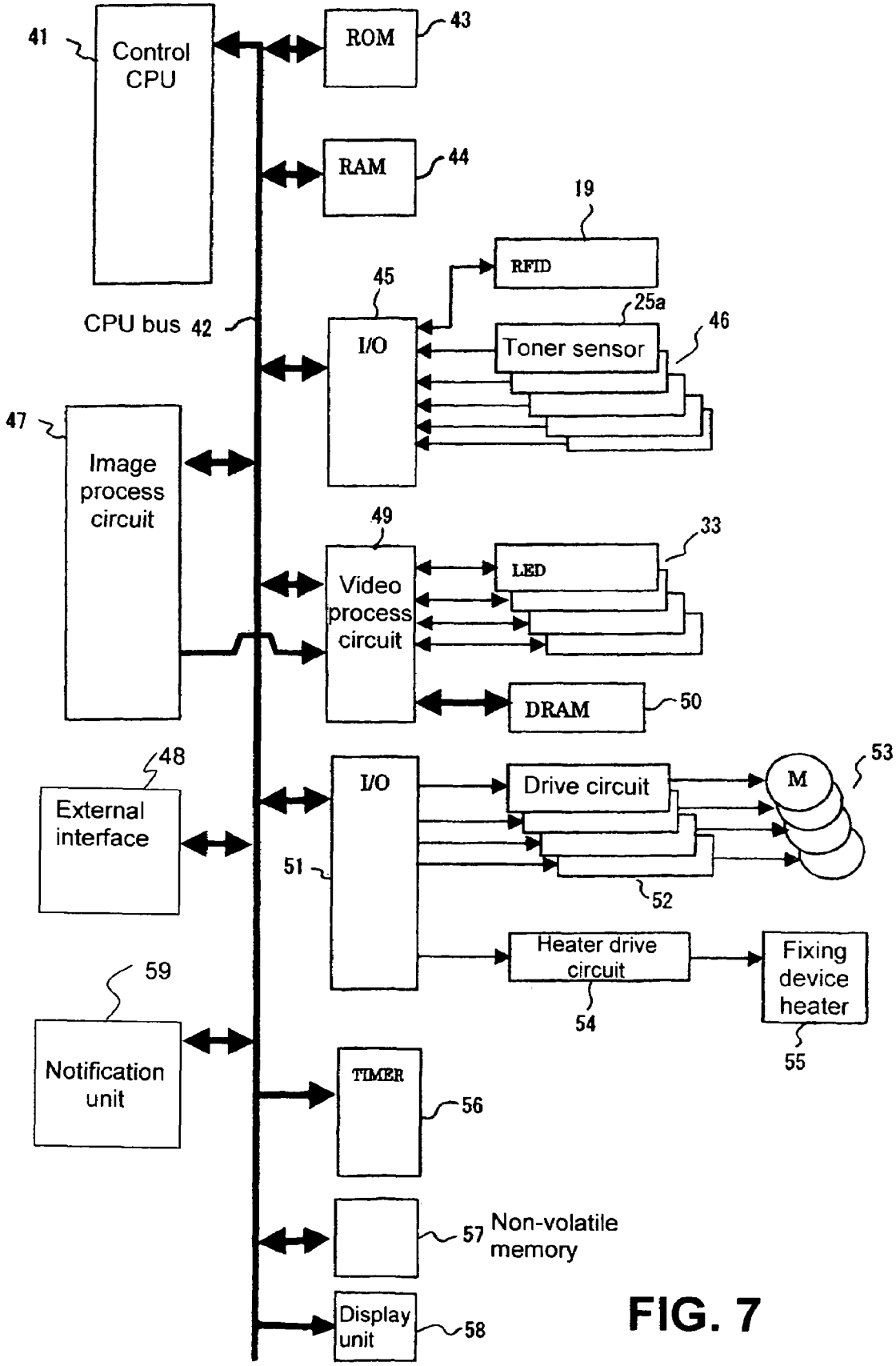
FIG. 7 is a block diagram showing a control system of the electric-photo printing apparatus according to the second embodiment of the present invention.

FIG. 7 is a block diagram showing a control system of the electric-photo printing apparatus according to the second embodiment of the present invention. As shown in FIG. 7, the input/output circuit 45 connected to the CPU bus 42 is connected to the various sensors 46 including the toner sensor 25*a* as well as the RFID reader 19. The CPU 41 can read and write data relative to the RFID reader 19 and the RFID tag 18. A non-volatile memory 57 is connected to the CPU bus 42 for storing data such as a count value of a remaining amount of toner in the image forming unit, so that data is retained in the memory even after the electric-photo printing apparatus is turned off. Further, the display unit 58 and a notification unit 59 are connected to the CPU bus 42.

Figure 8:
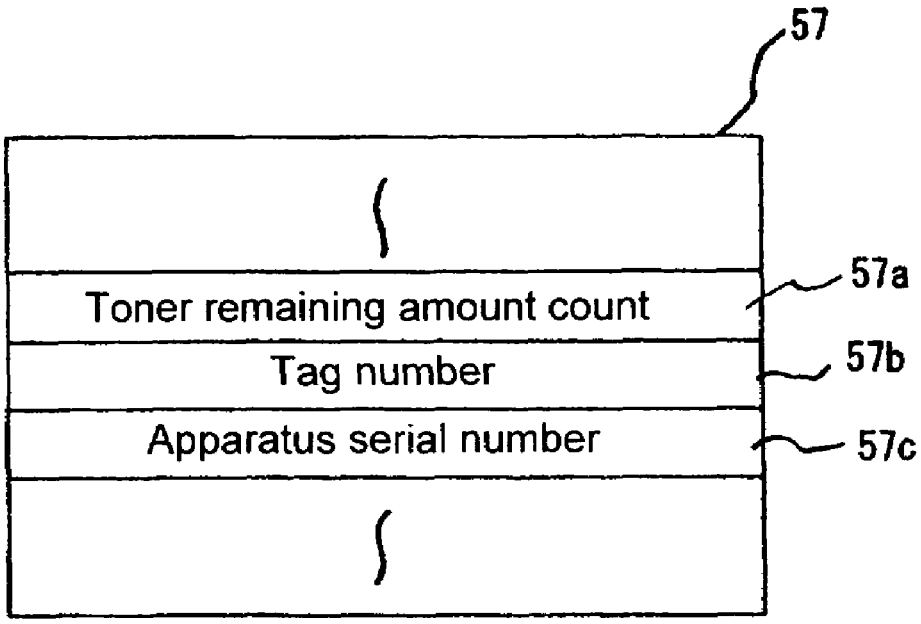
FIG. 8 is a schematic view showing a memory map of a non-volatile memory according to the second embodiment of the present invention.

FIG. 8 is a schematic view showing a memory map of the non-volatile memory 57 according to the second embodiment of the present invention. As shown in FIG. 8, the non-volatile memory 57 includes a toner remaining amount area 57*a* for storing "a toner remaining amount count value" corresponding to a remaining amount of toner in the image forming unit; a tag number area 57*b* for storing a specific tag number stored in the RFID tag 18 attached to the toner cartridge 16; and an apparatus serial number area 57*c* for storing an apparatus serial number, i.e., a serial number of the electric-photo printing apparatus written upon shipment from a manufacturing plant. The apparatus serial number area 57*c* is cleared before shipment of the printing apparatus from a manufacturing plant.

Figure 9:
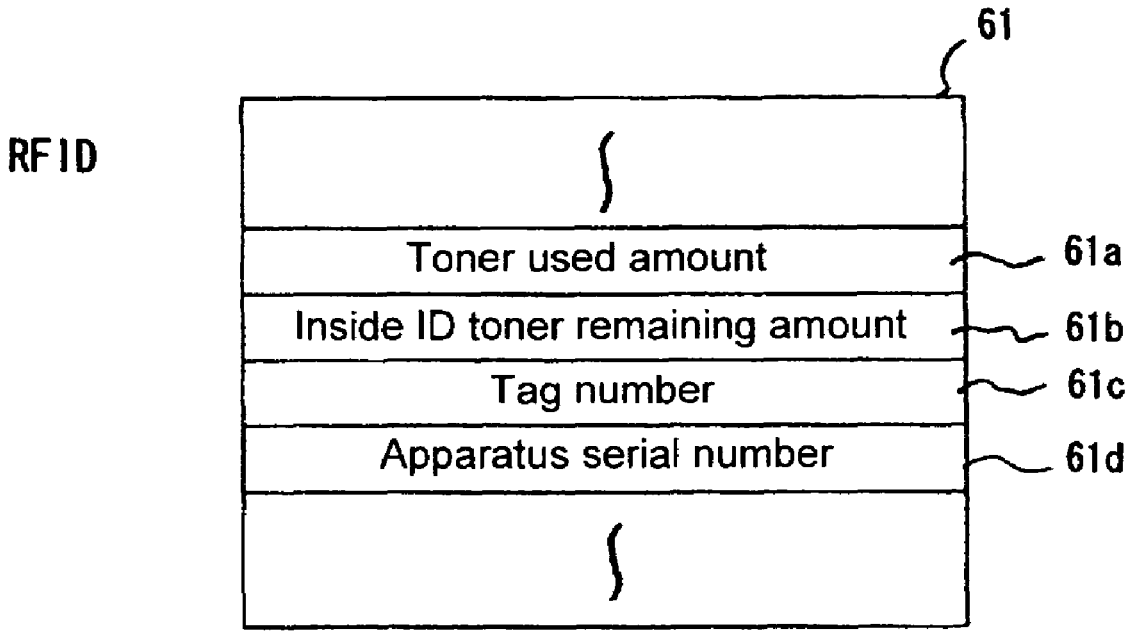
FIG. 9 is a schematic view showing a memory map of a memory in an RFID tag.

FIG. 9 is a schematic view showing a memory map of a memory 61 in the RFID tag 18 attached to the toner cartridge 16. As shown in FIG. 9, the memory 61 includes a toner used amount area 61*a* for storing an amount of toner in the toner cartridge 16 to be used for printing; an inside ID toner remaining amount area 61*b* for storing a remaining amount of toner in the image forming unit 5; a tag number area 61*c* for storing a specific tag number assigned to the RFID tag 18; and an apparatus serial number area 61*d* for storing an apparatus serial number of the electric-photo printing apparatus with the toner cartridge 16 attached thereto.

Figure 10:
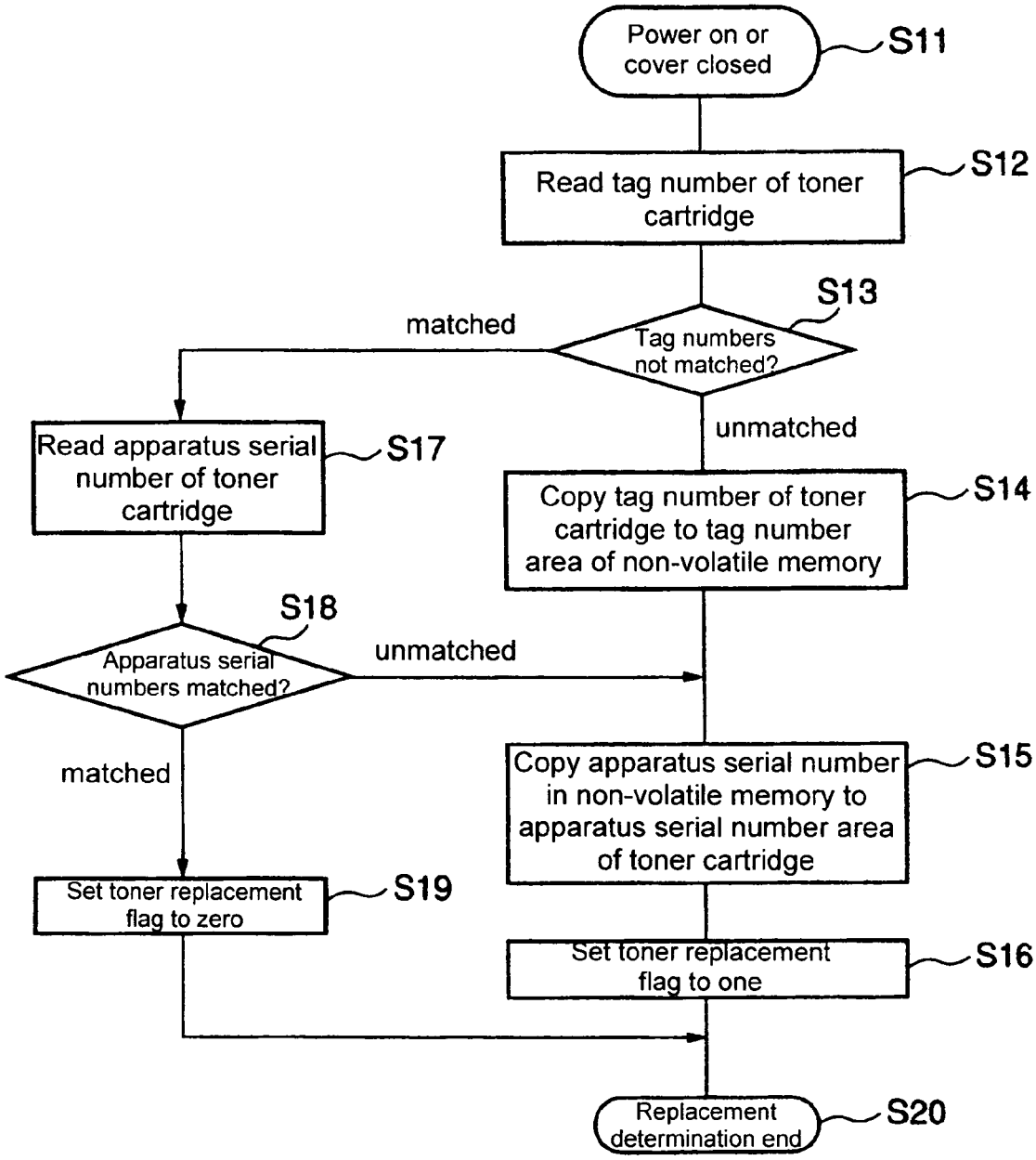
FIG. 10 is a flow chart showing an operation of the electric-photo printing apparatus according to the second embodiment of the present invention.

An operation of the electric-photo printing apparatus according to the second embodiment will be explained next. In the embodiment, the toner cartridge 16 is arranged to be detachable relative to the electric-photo printing apparatus 1. In some cases, the toner cartridge 16 may be detached from the electric-photo printing apparatus 1 and attached to another apparatus before toner in the toner cartridge 16 is completely consumed. In the second embodiment, it is possible to correctly detect a remaining amount of toner in the toner cartridge 16 in such a case. A process of replacing the toner cartridge 16 will be explained with refer to FIG. 10.

When the electric-photo printing apparatus 1 is turned on, or the control CPU 41 detects that the cover 10 is closed through a sensor (not shown) (step S11), the control CPU 41 controls the RFID reader 19 to read a specific tag number from the tag number area 61*c* of the RFID tag 18 of the toner cartridge 16 (step S12). Then, the control CPU 41 refers the read tag number to a tag number stored in the tag number area 57*b* of the non-volatile memory 57 to determine whether the tag numbers are matched (step S13). When both tag numbers are matched, the process proceeds to step S17. When both tag numbers are not matched, the process proceeds to step S14.

In step S14, the tag number read from the tag number area 61*c* of the RFID tag 18 is copied to the tag number area 57*b* of the non-volatile memory 57. In step S15, the apparatus serial number stored in the apparatus serial number area 57*c* of the non-volatile memory 57 is copied to the apparatus serial number area 61*d* of the RFID tag 18 of the toner cartridge 16. In step S16, a toner replacement flag is set to one, indicating that the toner cartridge 16 is replaced, and the process proceeds to step S20 to complete the toner replacement determining process.

When both tag numbers are matched in step S13, an apparatus serial number is read from the apparatus serial number area 61*d* of the RFID tag 18 of the toner cartridge 16. In step S18, the apparatus serial number read in step S17 is compared with the apparatus serial number stored in the apparatus serial number area 57*c* of the non-volatile memory 57. When the apparatus serial numbers are not matched, the process proceeds to step S15.

When the apparatus serial numbers are matched in step S18, the toner replacement flag is set to zero in step S19, indicating that the toner cartridge 16 is not replaced, and the process proceeds to step S20 to complete the toner replacement determining process.

As explained above, when the tag number stored in the non-volatile memory 57 is matched to the tag number stored in the RFID tag 18, and the apparatus serial number stored in the non-volatile memory 57 is matched to the apparatus serial number stored in the RFID tag 18, it is determined that the toner cartridge 16 is not replaced. Accordingly, for example, when the toner cartridge 16 is detached from the electric-photo printing apparatus 1 temporarily and is attached back to the electric-photo printing apparatus 1 afterwards, it is determined that the toner cartridge 16 is not replaced. Further, when the toner cartridge 16 is attached to another apparatus and the apparatus is turned on, it is determined that the toner cartridge 16 is replaced when the toner cartridge 16 is attached back to the electric-photo printing apparatus 1 afterwards. Therefore, it is possible to correctly detect the replacement of the toner cartridge 16.

An operation of detecting a remaining amount of toner when the toner cartridge 16 is detached from the electric-photo printing apparatus 1 and attached to another apparatus will be explained next. FIGS. 11(*a*) to 11(*d*) are schematic views showing a change in an amount of toner in the toner cartridge 16. In the explanation, it is assumed that the toner cartridge 16 is attached to another apparatus after toner therein is consumed to a certain extent.

When the toner cartridge 16 is attached to the electric-photo printing apparatus 1 and the shutter 22 is opened, toner in the toner cartridge 16 is supplied to the toner storage portion 24 of the image forming unit 5. Toner in the toner storage portion 24 is consumed for printing as the printing operation is performed. At this moment, an amount of toner supplied from the toner cartridge 16 is a sum of a used amount of toner actually used for the printing operation and a remaining amount of toner in the image forming unit 5 not used for the printing operation. In the embodiment, the replacement of the toner cartridge 16 is determined through the tag number specific to the RFID tag 18 and the serial number of the printing apparatus. Alternatively, it is possible to determine the replacement of the toner cartridge 16 simply through only the tag number specific to the RFID tag 18 or the serial number of the printing apparatus.

A method of determining a used amount of toner will be explained next. When the printing operation is performed, the control CPU 41 controls the inside counter of the video process circuit 49 to count the number of printed dots. The memory 61 in the RFID tag 18 of the toner cartridge 16 includes the toner used amount area 61*a* for storing an amount of toner in the toner cartridge 16 used for the printing operation. The number of printed dots counted by the inside counter is multiplied by the used amount of toner stored in the toner used amount area 61*a*, so that an amount of toner currently used is stored in the toner used amount area 61*a*. In FIG. 11(*a*), after a new toner cartridge 16 is attached to a new image forming unit 5, toner is supplied to the toner storage portion 24 from the toner cartridge 16 up to the toner full level 26.

A remaining amount of toner in the image forming unit 5 will be explained next. As explained above, the toner sensor lever 25 is disposed in the toner storage portion 24 of the image forming unit 5 for detecting the toner full level 26 and the toner low level 27. When an amount of toner in the toner storage portion 24 reaches the toner full level 26 or the toner low level 27, an amount of toner in the toner storage portion 24 is determined. Accordingly, when the toner full level 26 or the toner low level 27 is detected, the control CPU 41 writes "a remaining amount of toner in the image forming unit upon detection of the toner full level" or "a remaining amount of toner in the image forming unit upon detection of the toner low level" determined in advance to the toner remaining amount area 57*a* as a count value, thereby storing a current remaining amount of toner in the toner storage portion 24 of the image forming unit 5.

At this moment, the control CPU 41 also controls the inside counter of the video process circuit 49 to count the number of printed dots, and the count number is subtracted from the count value stored in the toner remaining amount area 57*a* of the non-volatile memory 57. Accordingly, an amount of toner actually used in the printing operation is subtracted from an initial toner remaining amount count value. Then, the control CPU 41 writes the subtracted count value to the inside ID toner remaining amount area 61*b* of the memory 61 in the RFID tag 18 of the toner cartridge 16. Accordingly, a current remaining amount of toner in the toner storage portion 24 of the image forming unit 5 is always stored in the inside ID toner remaining amount area 61*b*.

In FIGS. 11(*a*) to 11(*d*), an upper figure represents an amount of toner in the toner cartridge 16, and a lower figure represents a remaining amount of toner in a toner storage portion 24*a* of the image forming unit 5. In the lower figure, the toner full level 26 and the toner low level 27 are indicated. FIG. 11(*a*) shows a state right after the toner cartridge 16 is attached to the image forming unit 5 and toner is supplied to the toner storage portion 24*a* of the image forming unit 5 up to the toner full level 26. In this state, a used amount of toner in the toner used amount area 61*a* of the RFID tag 18 of the toner cartridge 16 is zero. A toner remaining amount count value corresponding to an amount of toner P1 is stored in the toner remaining amount area 57*a* of the non-volatile memory 57 of the electric-photo printing apparatus 1. Further, the toner remaining amount count value corresponding to the amount of toner P1 is stored in the inside ID toner remaining amount area 61*b* of the RFID tag 18 of the toner cartridge 16.

In the state shown in FIG. 11(*a*), when the printing operation is started, the control CPU 41 controls the inside counter of the video process circuit 49 to count a used amount of toner in the toner storage portion 24*a*. That is, the inside counter counts the number of printed dots, and the count result is added to the count value in the toner used amount area 61*a* of the RFID tag 18. Accordingly, a used amount of toner is always updated and stored in the toner used amount area 61*a*.

A count value corresponding to the used mount of toner is subtracted from the toner remaining count value stored in the toner remaining amount area 57*a* of the non-volatile memory 57 of the electric-photo printing apparatus 1 and the inside ID toner remaining amount area 61*b* of the RFID tag 18 of the toner cartridge 16. Accordingly, a remaining amount of toner in the image forming unit 5 is stored in the toner remaining amount area 57*a* and the inside ID toner remaining amount area 61*b*.

As the printing operation proceeds, an amount of toner in the toner storage portion 24*a* gradually decreases. When it is detected that a remaining amount of toner reaches the toner low level 27, toner is supplied from the toner cartridge 16 up to the toner full level 26. At this moment, the count value stored in the inside ID toner remaining amount area 61*b* is updated to a toner remaining amount count value corresponding to the toner full level 26.

FIG. 11(*b*) shows a state after the printing operation is performed from the state shown in FIG. 11(*a*). In this state, the toner remaining amount count value corresponding to a remaining amount of toner P2 in the toner storage portion 24*a* is stored in the toner remaining amount area 57*a* of the non-volatile memory 57 and the inside ID toner remaining amount area 61*b* of the RFID tag 18. An amount of toner P4, i.e., a sum of the remaining mount P2 in the toner storage portion 24*a* and an amount P3 used for the printing operation, is supplied by this moment. A count value corresponding to the amount P3 used for the printing operation is stored in the toner used amount area 61*a* of the RFID tag 18 of the toner cartridge 16.

It is supposed that the toner cartridge 16 is removed from the electric-photo printing apparatus 1 and attached to another apparatus from the state shown in FIG. 11(*b*). It is detected that the toner cartridge 16 is replaced through the process shown in FIG. 10. FIG. 11(*c*) shows a state that the toner cartridge 16 is attached to another apparatus. In the state shown in FIG. 11(*c*), it is supposed that a remaining amount of toner P5 is retained in a toner storage portion 24*b*. Note that the remaining amount of toner P5 is different from the remaining mount P2. A toner remaining amount count value corresponding to the remaining amount of toner P5 is stored in the toner remaining amount area 57*a* of the non-volatile memory 57 of the apparatus to which the toner cartridge 16 is attached.

When it is detected that the toner cartridge 16 is replaced, the control CPU 41 of the apparatus corrects an amount of toner stored in the toner used amount area 61*a* of the RFID tag 18 of the toner cartridge 16. That is, it is assumed that the remaining mount of toner P2 in the previous apparatus is already consumed, and a count value corresponding to the remaining mount of toner P2 is added the used amount of toner P3 stored in the toner used amount area 61*a*. The count value corresponding to the remaining mount of toner P2 is stored in the inside ID toner remaining amount area 61*b* of the RFID tag 18. Accordingly, a used amount of toner P4 is updated as a sum of the used amount of toner P3 and the inside ID remaining mount of toner P2.

When toner remains in the apparatus to which the toner cartridge 16 is attached (the remaining amount of toner P5 shown in FIG. 11(*c*)), it is possible to use the remaining amount of toner P5. Accordingly, it is assumed that the remaining amount of toner P5 is supplied from the toner cartridge 16, so that the remaining amount of toner P5 is subtracted from the used amount of toner. As described above, the count value corresponding to the remaining amount of toner P5 is stored in the toner remaining amount area 57*a* of the non-volatile memory 57 of the apparatus to which the toner cartridge 16 is attached. Accordingly, a used amount of toner P6 is updated as a sum of the used amount of toner P4 and the inside ID remaining mount of toner P5, and is stored in the toner used amount area 61*a* of the RFID tag 18 of the toner cartridge 16.

Further, the control CPU 41 rewrites the count value corresponding to the remaining amount of toner P2 stored in the inside ID toner remaining amount area 61*b* of the memory 61 in the RFID tag 18 of the toner cartridge 16 to a toner remaining amount count value corresponding to the remaining amount of toner P5 stored in the toner remaining amount area 57*a* of the non-volatile memory 57 of the apparatus to which the toner cartridge 16 is attached. That is, the control CPU 41 sets the inside ID toner remaining amount equal to the remaining amount of toner P5. Through the process described above, the control CPU 41 corrects the count values stored in the toner used amount area 61*a* and the inside ID toner remaining amount area 61*b* of the memory 61 in the RFID tag 18 of the toner cartridge 16.

In the following printing operation, the number of printed dots is counted, and the count value stored in the toner used amount area 61*a* is added. When an amount of toner in the toner storage portion 24*b* reaches the toner low level 27, toner is supplied from the toner cartridge 16 to the toner storage portion 24*b* as shown in FIG. 11(*d*). As this process is repeated, the count value stored in the toner used amount area 61*a* continues being added. The count value stored in the toner used amount area 61*a* is displayed on the display unit 58 under control of the control CPU 41. The used amount of toner may be defined relative to the toner cartridge 16, and may represent information equivalent to a remaining amount of usable toner since an initial amount of toner in the toner cartridge 16 is determined in advance. It may be arranged such that information regarding the used amount of toner is sent to an external device from the notification unit 59 through the external interface 48, so that the information is displayed on the external device. It may be arranged such that the display unit 58 displays that the used amount of toner exceeds a specific level, that is, the usable amount of toner becomes below a specific level. Such information may be notified to an external device.

As explained above, in the second embodiment, the used amount of toner used for the printing operation is counted. The amount of toner supplied to the image forming unit 5 from the toner cartridge 16 and not used for the printing operation is stored in the RFID tag 18 of the toner cartridge 16 as the inside ID toner remaining amount. The remaining amount of toner in the image forming unit 5 is also stored in the electric-photo printing apparatus 1, so that the used amount of toner is corrected when the toner cartridge 16 is attached to another apparatus. Accordingly, it is possible to correctly detect the remaining amount of toner even after the toner cartridge is replaced, thereby using toner more effectively.

As described above, in the first and second embodiments of the present invention, it is possible to detect the remaining amount of toner in the printing apparatus. Further, it is possible to arbitrarily set the toner remaining amount count value for determining that toner does not remain in the printing apparatus. In a usual case, the toner remaining amount count value is set at a point where a small amount of toner sill remains in the printing apparatus, not where toner is completely consumed. That is, when it is determined that toner is not remained in the printing apparatus, a small amount of toner sill remains in the printing apparatus. In a third embodiment, it is possible to use a small amount of toner still remaining in the printing apparatus.

FIG. 12 is a schematic view showing a memory map of a non-volatile memory according to the third embodiment of the present invention. In the third embodiment, a printing apparatus has a configuration same as that in the second embodiment, except that the non-volatile memory has the memory map different from that in the second embodiment. As shown in FIG. 12, a non-volatile memory 62 includes a continued operation flag area 62*b*, in addition to a toner used amount area 62*a* for storing a toner remaining amount count value corresponding to a remaining amount of toner in the image forming unit 5. The continued operation flag area 62*b* is provided for storing a continued operation flag for determining whether the printing operation is continued when it is determined that the image forming unit 5 reaches the life thereof. It is possible to set the continued operation flag to one or zero through an operation of an operational panel (not shown) of the printing apparatus.

Figure 13:
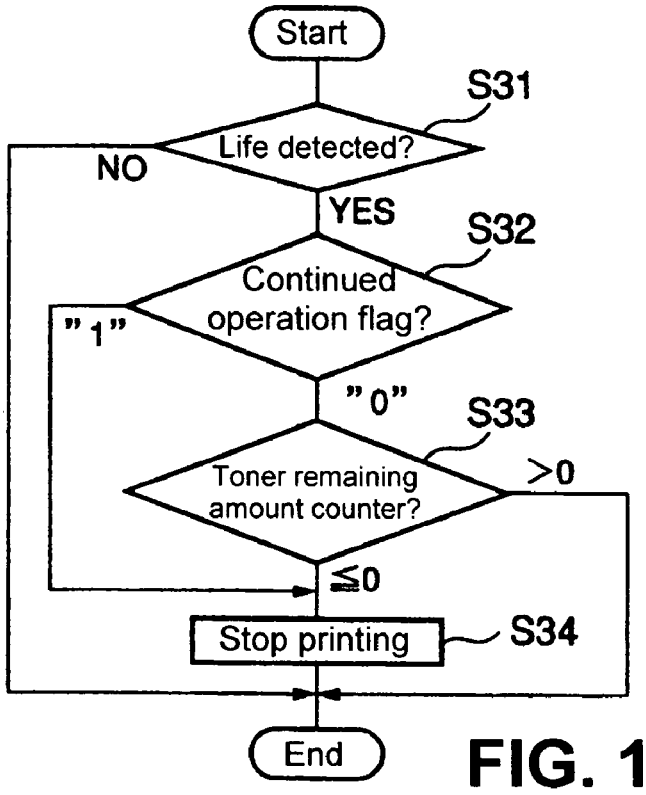
FIG. 13 is a flow chart showing an operation of the electric-photo printing apparatus according to the third embodiment of the present invention.

FIG. 13 is a flow chart showing an operation of the electric-photo printing apparatus according to the third embodiment of the present invention. The operation of the electric-photo printing apparatus according to the third embodiment will be explained with refer to FIG. 7 as well as FIG. 13. It is supposed that the continued operation flag is set to one or zero in advance. In this case, when the continued operation flag is set to one, the printing operation is not continued. When the continued operation flag is set to zero, the printing operation is continued.

In step S31, when the control CPU 41 detects that the image forming unit 5 reaches the life thereof (at this moment, a small amount of toner may still remain in the image forming unit 5), the control CPU 41 determines whether the continued operation flag stored in the continued operation flag area 62*b* is set to one or zero (step S32). When it is determined that the continued operation flag is set to one, the process proceeds to step S34, and the printing operation is stopped.

When it is determined that the continued operation flag is set to zero in step S32, the control CPU 41 determines the toner remaining amount count value stored in the toner used amount area 62*a* of the non-volatile memory 62 (step S33). When the control CPU 41 determines that the toner remaining amount count value is not set to zero, that is, toner still remains, the printing operation is continued. When the control CPU 41 determines that toner does not remain, the printing operation is stopped (step S34).

In the third embodiment explained above, in a normal case, when the image forming unit 5 reaches the life thereof, the printing operation is stopped, thereby maintaining print quality. When a user desires to use all of toner in the image forming unit 5 even with deteriorating print quality, it is possible to completely use toner in the image forming unit 5, thereby making the printing apparatus more flexible to meet various needs.

In the second embodiment, the non-volatile memory 57 is provided in the printing apparatus, and the RFID tag 18 with the memory is provided in the toner cartridge 16, so that it is possible to detect that the toner cartridge 16 is replaced. However, in an actual case, the toner cartridge 16 is not always a standard one. In a fourth embodiment, it is possible to deal with a case when a non-standard toner cartridge is attached to the printing apparatus.

Figure 14:
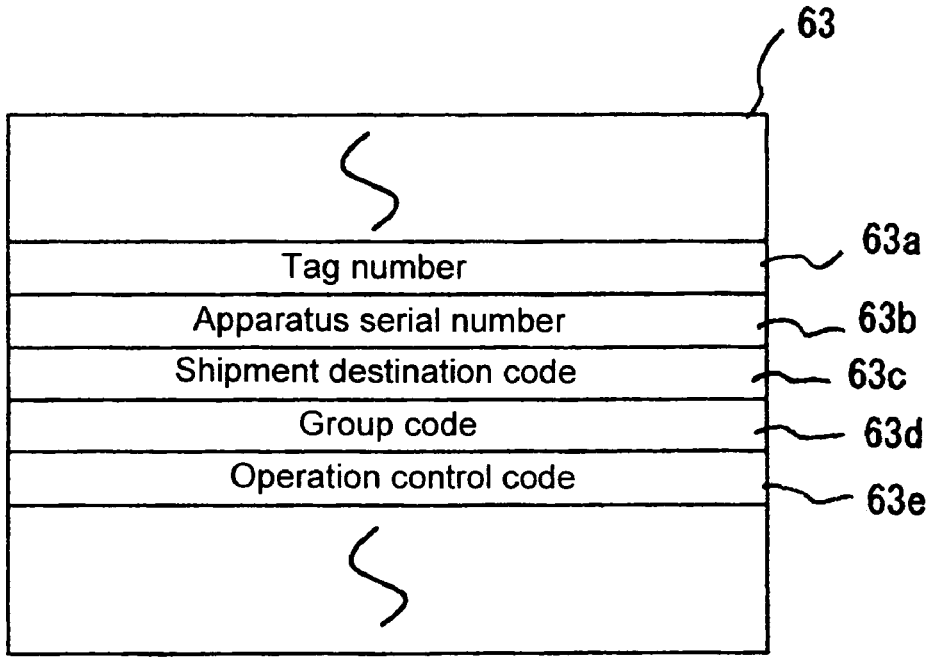
FIG. 14 is a schematic view showing a memory map of a non-volatile memory according to a fourth embodiment of the present invention.

In the fourth embodiment, a configuration is the same as that in the second embodiment, except that a non-volatile memory has a different content. FIG. 14 is a schematic view showing a memory map of a non-volatile memory 63 according to the fourth embodiment of the present invention. As shown in FIG. 14, the non-volatile memory 63 includes a tag number area 63*a* for storing a specific tag number stored in the RFID tag 18 of the toner cartridge 16 to be attached to the printing apparatus; an apparatus serial number area 63*b* for storing an apparatus serial number, i.e., a serial number of the electric-photo printing apparatus written upon shipment from a manufacturing plant; a shipment destination code area 63*c* for storing a shipment destination code indicating a shipment destination written upon shipment from a manufacturing plant; a shipment group code area 63*d* for storing a shipment group code of the electric-photo printing apparatus indicating an area in which specifications are standardized (for example, Europe, North America, etc.); and an operational control code area 63*e* for storing an operational control code for controlling supply. The non-volatile memory 63 also includes a toner remaining amount area (not shown) for storing a toner remaining amount count value corresponding to a remaining amount of toner in the image forming unit 5.

Figure 15:
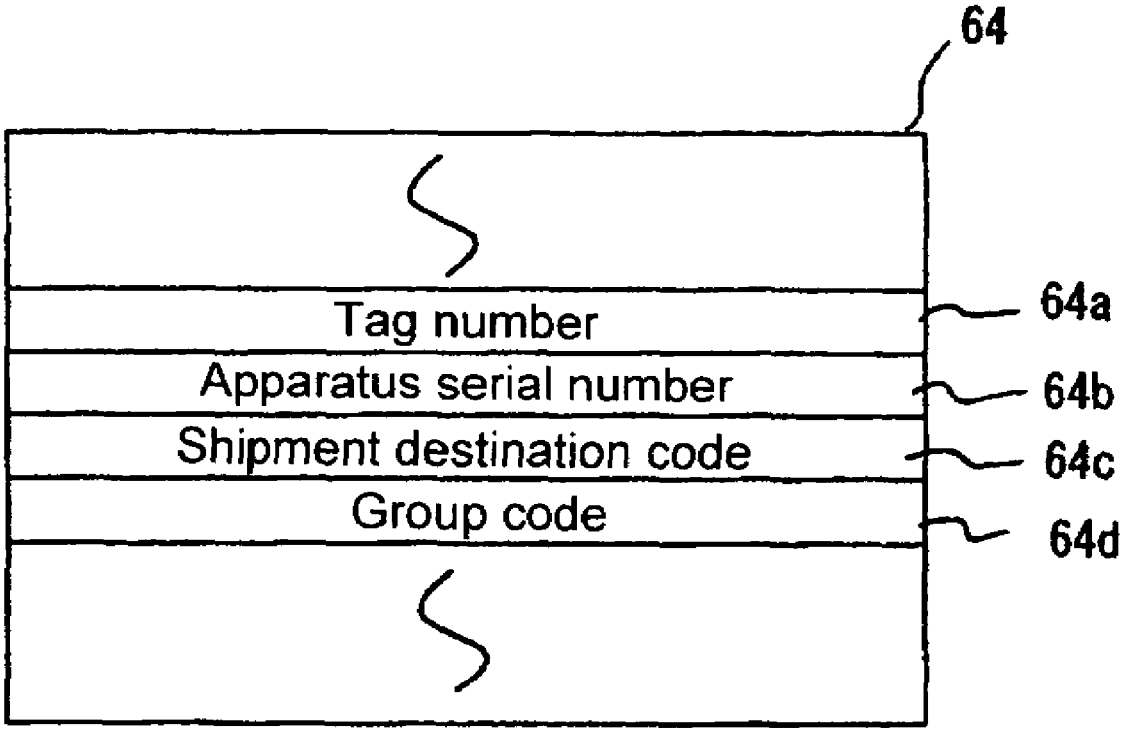
FIG. 15 is a schematic view showing a memory map of a memory in an RFID tag to be attached to a toner cartridge.

FIG. 15 is a schematic view showing a memory map of a memory 64 in the RFID tag 18 to be attached to the toner cartridge 16 according to the fourth embodiment of the present invention. As shown in FIG. 15, the memory 64 includes a tag number area 64*a* for storing a specific tag number stored in the RFID tag 18; an apparatus serial number area 64*b* for storing an apparatus serial number, i.e., a serial number of the electric-photo printing apparatus; a shipment destination code area 64*c* for storing a shipment destination code indicating a shipment destination written upon shipment from a manufacturing plant; and a shipment group code area 64*d* for storing a shipment group code of the electric-photo printing apparatus. The memory 64 also includes a toner used amount area (not shown) for storing an amount of toner in the toner cartridge 16 used for the printing operation, and an inside ID toner remaining amount area (not shown) for storing a remaining amount of toner in the image forming unit 5.

Figure 16:
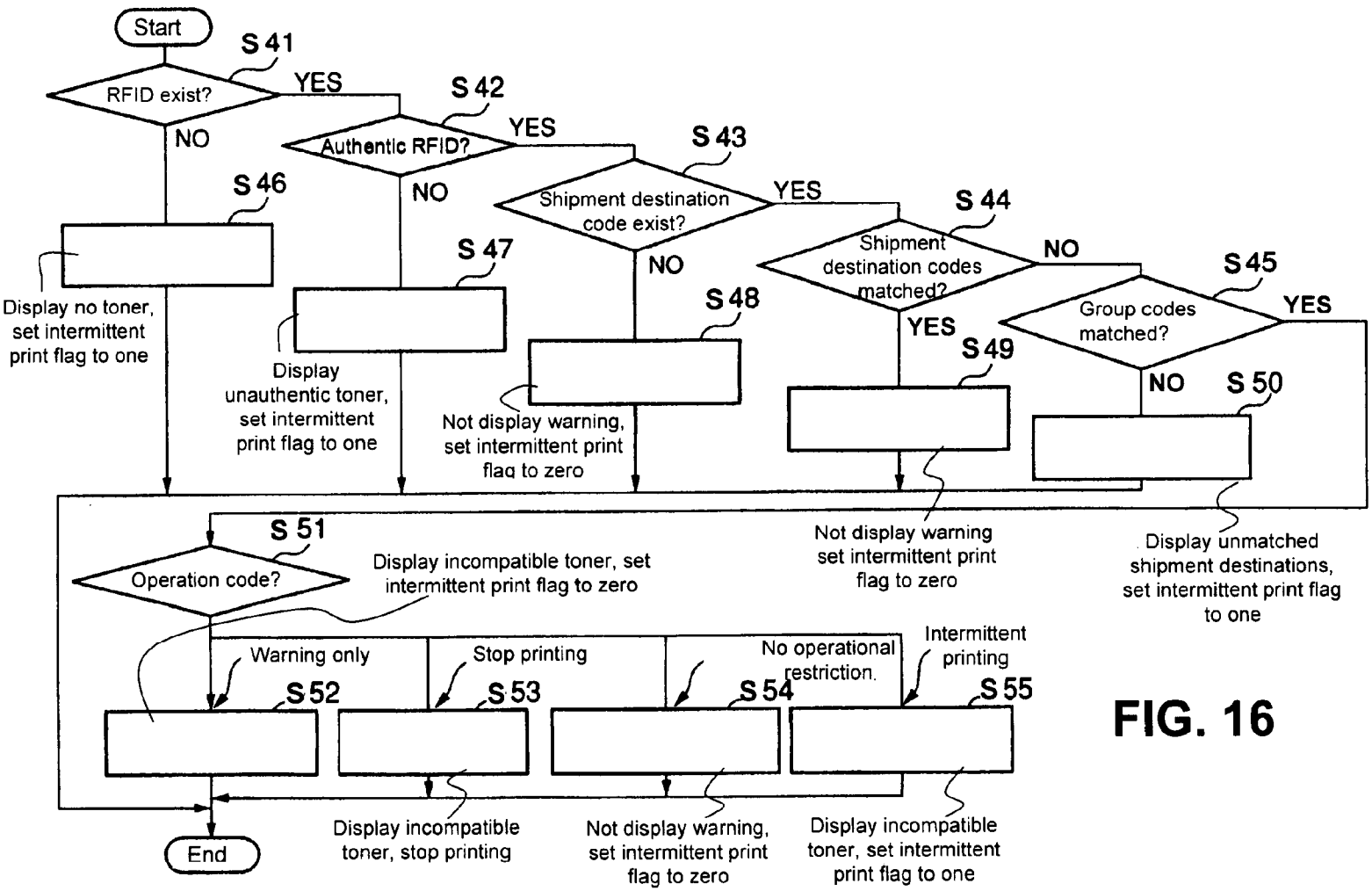
FIG. 16 is a flow chart showing an operation of the electric-photo printing apparatus according to the fourth embodiment of the present invention.

FIG. 16 is a flow chart showing an operation of the electric-photo printing apparatus according to the fourth embodiment of the present invention. The operation of the electric-photo printing apparatus according to the fourth embodiment will be explained with refer to FIG. 7 as well as FIG. 16.

When the electric-photo printing apparatus 1 is turned on, or the control CPU 41 detects that the cover 10 is closed through a sensor (not shown), the control CPU 41 controls the RFID reader 19 to determine whether it is possible to read a specific tag number from the tag number area 64*a* of the RFID tag 18 of the toner cartridge 16 (step S41). When it is possible to read the tag number, the process proceeds to step S42. When it is not possible to read the tag number, the process proceeds to step S46.

In step S46, the control CPU 41 determines that the RFID tag 18 or the toner cartridge 16 does not exist, and displays "No toner" on the display unit 58 of the electric-photo printing apparatus 1. Further, the control CPU 41 sets an intermittent print flag to one for stopping the printing operation intermittently, so that a user is notified during the printing operation afterwards, and stops the printing operation. The intermittent print flag is provided in the non-volatile memory 63.

In step S42, the control CPU 41 determines whether the read tag number is a predetermined specific number. When it is determined that the tag number is the specific number, the process proceeds to step S43. When it is determined that the tag number is not the specific number, the process proceeds to step S47.

In step S47, the control CPU 41 determines that the tag number is not the specific number, that is, an unauthentic cartridge is attached to the printing apparatus, and displays "Unauthentic cartridge" on the display unit 58 of the electric-photo printing apparatus 1. Further, the control CPU 41 sets the intermittent print flag to one for stopping the printing operation intermittently, so that a user is notified during the printing operation afterwards, and stops the printing operation.

In step S43, the control CPU 41 controls the RFID reader 19 to read stored data from the shipment destination code area 64*c* and the shipment group code area 64*d* in the RFID tag 18 of the toner cartridge 16. Then, the control CPU 41 determines whether the read data match to one of the codes indicating a shipment destination and specified in advance. When the data match to one of the codes, the process proceeds to step S44. When the data do not match to the codes, the process proceeds to step S48.

In step S48, the control CPU 41 determines that the read data do not match to the shipment destination code and the shipment group code, that is, an authentic cartridge is attached to the printing apparatus. Accordingly, the control CPU 41 sets the intermittent print flag to zero for not stopping the printing operation intermittently and not warning a user, and stops the printing operation.

In step S44, the control CPU 41 compares the shipment destination code read from the shipment destination code area 64*c* with the shipment destination code stored in the shipment destination code area 63*c* of the non-volatile memory 63 to determine whether they are matched. When they are not matched, that is, a toner cartridge not meeting a specification of the printing apparatus is attached to the printing apparatus, the process proceeds to step S45. When the shipment destination code of the cartridge matches to the shipment destination code of the printing apparatus, the process proceeds to step S49.

In step S49, the control CPU 41 determines that the shipment destination code of the cartridge matches to the shipment destination code of the printing apparatus, that is, the cartridge for a correct shipment destination is attached to the printing apparatus. Accordingly, the control CPU 41 sets the intermittent print flag to zero for not stopping the printing operation intermittently and not warning a user, and stops the printing operation.

In step S45, the control CPU 41 compares the shipment group code read from the shipment group code area 64*d* with the shipment group code stored in the shipment group code area 63*d* of the non-volatile memory 63 to determine whether they are matched. When they are not matched, the process proceeds to step S50. When they are not matched, the process proceeds to step S51.

In step S50, the control CPU 41 determines that the shipment destination codes and the shipment group codes are not matched between the cartridge and the printing apparatus, that is, a cartridge with a wrong specification is attached to the printing apparatus, and displays "Unmatched shipment destination" on the display unit 58 of the electric-photo printing apparatus 1. Further, the control CPU 41 sets the intermittent print flag to one for stopping the printing operation intermittently, so that a user is notified during the printing operation afterwards, and stops the printing operation.

In step S51, when the shipment destination codes are not matched and the shipment destination group codes are matched, the control CPU 41 refers to the operational control code stored in the operational control code area 63*e* of the non-volatile memory 63. When the operational control code is a code indicating only warning, the process proceeds to step S52. When the operational control code is a code indicating stop printing, the process proceeds to step S53. When the operational control code is a code indicating no operational restriction, the process proceeds to step S54. When the operational control code is a code indicating intermittent printing, the process proceeds to step S55.

In step S52, the control CPU 41 displays "Incompatible toner" on the display unit 58 of the electric-photo printing apparatus 1. In this case, the control CPU 41 sets the intermittent print flag to zero for not restricting the printing operation, and stops the printing operation. In step S53, the control CPU 41 displays "Incompatible toner" on a display unit (not shown), and stops the printing operation. In step S54, the control CPU 41 sets the intermittent print flag to zero for not restricting the printing operation, and stops the printing operation. In step S55, the control CPU 41 displays "Incompatible toner" on a display unit (not shown), and sets the intermittent print flag to one for stopping the printing operation intermittently, and stops the printing operation.

As described above, even when an unauthentic cartridge is attached to the printing apparatus, it is possible to perform a proper operation according to a type of cartridge. Accordingly, it is possible to select a shipment destination according to a request of a user.

The disclosure of Japanese Patent Application No. 2005-085234, filed on Mar. 24, 2005, is incorporated in the application.

While the invention has been explained with reference to the specific embodiments of the invention, the explanation is illustrative and the invention is limited only by the appended claims.

What is claimed is:

1. An image forming apparatus, comprising:

an image forming unit for forming an image, said image forming unit receiving toner from a toner cartridge detachably attached to the image forming unit, said image forming unit including a toner storage portion for retaining the toner;

a toner supply control unit for controlling an amount of the toner supplied from the toner cartridge to the image forming unit;

a remaining toner amount detection unit for detecting a remaining amount of the toner in the toner storage portion;

an image forming unit used amount detection unit for detecting a used amount of the image forming unit; and a control unit for controlling the toner supply control unit to control the amount of the toner in the toner storage portion according to a detection result of the remaining toner amount detection unit and a detection result of the image forming unit used amount detection unit.

2. The image forming apparatus according to claim 1, wherein said toner supply control unit is disposed in the image forming unit.

3. The image forming apparatus according to claim 1, wherein said image forming unit further includes an inlet opening for receiving the toner, said toner supply control unit including a regulating member for opening and closing the inlet opening.

4. The image forming apparatus according to claim 1, wherein said remaining toner amount detection unit is adapted to stir the toner in the toner storage portion.

5. An image forming apparatus comprising, an image forming unit for forming an image, said image forming unit receiving toner from a toner cartridge detachably attached to the image forming unit;

a toner supply control unit for controlling an amount of the toner supplied from the toner cartridge to the image forming unit;

a remaining toner amount detection unit for detecting a remaining amount of the toner in the image forming unit;

an image forming unit used amount detection unit for detecting a used amount of the image forming unit; and a control unit for controlling the toner supply control unit to control the amount of the toner in the image forming unit according to a detection result of the remaining toner amount detection unit and a detection result of the image forming unit used amount detection unit, wherein said control unit controls the toner supply control unit to stop supplying the toner from the toner cartridge so that the toner in the image forming unit is consumed to a specific amount when a calculation result of the image forming unit used amount detection unit exceeds a life of the image forming unit.

6. The image forming apparatus according to claim 5, further comprising a display unit for displaying a message indicating that the image forming unit reaches the life thereof when the amount of the toner in the image forming unit decreases to the specific amount.

7. The image forming apparatus according to claim 5, wherein said control unit controls the image forming unit not to form the image after the amount of the toner in the image forming unit decreases to the specific amount.

8. The image forming apparatus according to claim 5, wherein said control unit is adapted to select whether the control unit controls the image forming unit not to form the image after the amount of the toner in the image forming unit decreases to the specific amount.

9. An image forming apparatus comprising:

an image forming unit for forming an image;

a toner cartridge detachably attached to the image forming unit for supplying toner to the image forming unit, said toner cartridge having a storage medium for storing information;

a used toner amount calculation unit for calculating a used amount of the toner;

a remaining toner amount detection unit for detecting a remaining amount of the toner in the image forming unit;

a remaining toner amount storage unit for storing a detection result of the remaining toner amount detection unit;

a toner information writing unit for writing used toner amount information calculated by the used toner amount calculation unit and remaining toner amount information detected by the remaining toner amount detection unit to the storage medium disposed in the toner cartridge;

a toner information reading unit for reading the used toner amount information and the remaining toner amount information stored in the storage medium disposed in the toner cartridge;

a replacement detection unit for detecting that the toner cartridge is replaced; and a control unit for calculating a usable amount of the toner based on the used toner amount information and the remaining toner amount information read by the toner information reading unit and the remaining toner amount stored in the remaining toner amount storage unit.

10. The image forming apparatus according to claim 9, further comprising a display unit for displaying the usable amount of the toner.

11. The image forming apparatus according to claim 9, further comprising a notification unit for notifying the usable amount of the toner.

12. The image forming apparatus according to claim 9, wherein said replacement detection unit includes a toner cartridge identification information obtaining unit for obtaining toner cartridge identification information capable of identifying the toner cartridge from the toner cartridge; a toner cartridge identification information storage unit for storing the toner cartridge identification information obtained by the toner cartridge identification information obtaining unit; and a comparison unit for comparing the toner cartridge identification information obtained by the toner cartridge identification information obtaining unit with the toner cartridge identification information stored in the toner cartridge identification information storage unit.

13. The image forming apparatus according to claim 12, wherein said control unit controls the image forming unit according to the toner cartridge identification information obtained by the toner cartridge identification information obtaining unit.

14. The image forming apparatus according to claim 9, wherein said replacement detection unit includes an apparatus identification information writing unit for writing apparatus identification information to the storage medium disposed in the toner cartridge, and an apparatus identification information reading unit for reading the apparatus identification information from the storage medium.

15. The image forming apparatus according to claim 9, wherein said storage medium includes a wireless tag.

16. The image forming apparatus according to claim 9, further comprising a notification unit for notifying a status of the image forming apparatus, said notification unit notifying that the usable amount of the toner becomes below a specific level.

17. A toner cartridge to be attached to an image forming apparatus for supplying toner to an image forming unit of the image forming apparatus, comprising:

a storage medium for storing information from an image forming apparatus to which the image forming unit is to be attached, said storage medium storing information regarding a used amount of the toner and information regarding a remaining amount of the toner in the image forming unit.

18. The toner cartridge according to claim 17, wherein said storage medium stores identification information specific to the toner cartridge.

19. The toner cartridge according to claim 17, wherein storage medium stores identification information specific to the image forming apparatus.

* * * * *